US008585249B2

(12) United States Patent
Huang

(10) Patent No.: US 8,585,249 B2
(45) Date of Patent: Nov. 19, 2013

(54) LAMP HOLDER OF LED PROJECTION LAMP

(76) Inventor: Tsung-Hsien Huang, I-Lan Hsien (TW)

( * ) Notice: Subject to any disclaimer, the term of this patent is extended or adjusted under 35 U.S.C. 154(b) by 168 days.

(21) Appl. No.: 13/242,622

(22) Filed: Sep. 23, 2011

(65) Prior Publication Data

US 2013/0077323 A1 Mar. 28, 2013

(51) Int. Cl.
*F21V 7/20* (2006.01)
*F21V 7/10* (2006.01)

(52) U.S. Cl.
USPC ..... 362/294

(58) Field of Classification Search
USPC ..... 363/294; 362/294, 311.01–311.15; 313/46
See application file for complete search history.

(56) References Cited

U.S. PATENT DOCUMENTS

2010/0126697 A1* 5/2010 Huang ..... 165/80.3

* cited by examiner

*Primary Examiner* — Karabi Guharay
*Assistant Examiner* — Nathaniel Lee
(74) *Attorney, Agent, or Firm* — Pai Patent & Trademark Law Firm; Chao-Chang David Pai

(57) ABSTRACT

A lamp holder of an LED projection lamp includes a heat dissipation pipe, a heat dissipation fin unit, a heat dissipation tray, and a lampshade. The heat dissipation fin unit includes a plurality of heat dissipation fins surrounding and coupled to the heat dissipation pipe. One end of the heat dissipation pipe is tightly connected to the heat dissipation tray to form a specious accommodation surface to accommodate a plurality of LED illumination units therein. The heat dissipation tray is further connected with the lampshade to constitute the lamp holder of the LED projection lamp which can be coupled with more LED illumination units.

9 Claims, 10 Drawing Sheets

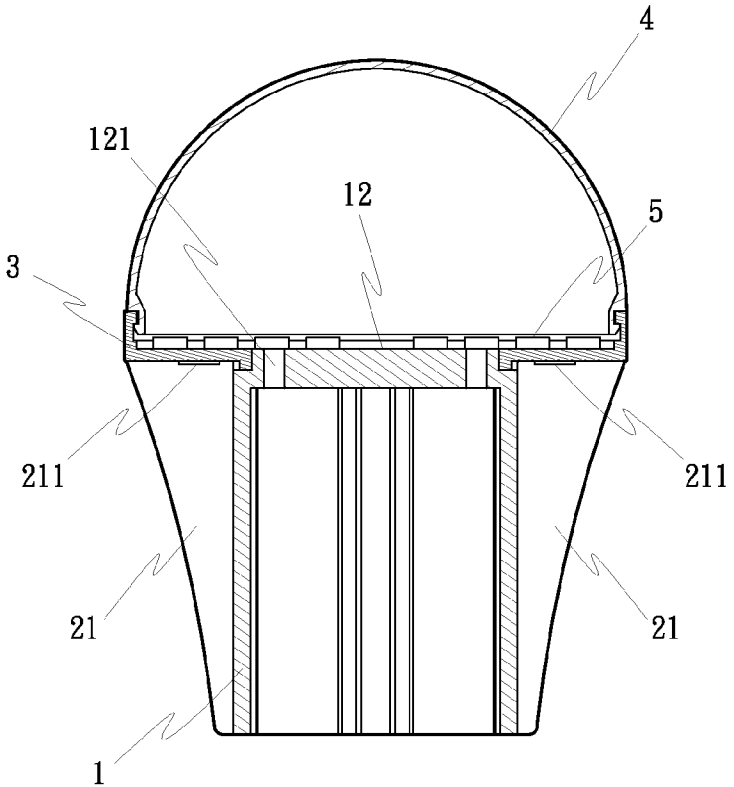
FIG. 6 A–A
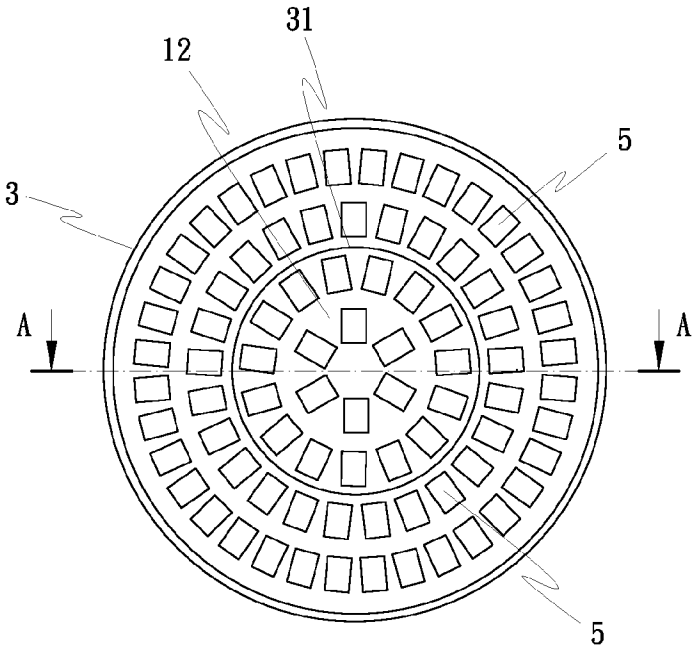
FIG. 5

LAMP HOLDER OF LED PROJECTION LAMP

BACKGROUND OF THE INVENTION (a) Field of the Invention

The present invention relates to a lamp holder of an LED projection lamp, and more particularly to a lamp holder having a heat dissipation pipe and a heat dissipation tray. The end of the heat dissipation pipe is connected to the heat dissipation tray to form a spacious accommodation surface to couple with more LED illumination units.

(b) Description of the Prior Art

An LED projection lamp has the character of low power consumption. However, its LED illumination unit is not heat-resistant. It is required to solve the problems of high temperature and heat dissipation. The heat dissipation effect of the lamp holder of the conventional LED lamp is not good. The conventional LED lamp is unable to mount many LED illumination units because of the heat dissipation problem, so it can only provide lower illumination.

A conventional LED projection lamp comprises a lamp holder, an LED illumination unit and an electric connector. The electric connector cooperated with an insulation sleeve is coupled to the inner wall of the lamp holder to achieve the insulation effect. This conventional lamp holder is formed by die casting, and the heat dissipation fins on the outer wall of the lamp holder are also formed by metallic die casting. The lamp holder is heavy and the number of the heat dissipation fins is limited. The heat dissipation fins cannot be concentrated, and its heat dissipation effect is bad. The LED lamp is heavy and cost-effective.

The heat dissipation fins may be inserted to a heat dissipation pipe to constitute a heat dissipation casing. The heat dissipation casing only has a narrow space to receive an LED illumination unit because the dimension of the heat dissipation pipe is small, so the illumination effect of the LED illumination unit is not perfect.

Accordingly, the inventor of the present invention has devoted himself based on his many years of practical experiences to solve these problems.

SUMMARY OF THE INVENTION

The primary object of the present invention is to provide a lamp holder of an LED projection lamp. The lamp holder comprises a heat dissipation pipe, a heat dissipation fin unit, a heat dissipation tray, and a lampshade. The heat dissipation fin unit comprises a plurality of heat dissipation fins which are coupled to the heat dissipation pipe. One end of the heat dissipation pipe is tightly connected to the heat dissipation tray to form a spacious accommodation surface to accommodate a plurality of LED illumination units therein. The heat dissipation tray is further connected with the lampshade to constitute the lamp holder of the LED projection lamp which can be coupled with more LED illumination units to provide a better illumination effect.

Another object of the present invention is to provide a lamp holder of an LED projection lamp, wherein the end of the heat dissipation pipe has a stepped protrusion and the heat dissipation tray has a central hole corresponding to the stepped protrusion of the heat dissipation pipe. The heat dissipation pipe and the heat dissipation tray are quickly connected by the stepped protrusion to engage with the central hole.

A further object of the present invention is to provide a lamp holder of an LED projection lamp, wherein the heat dissipation tray has a bottom formed with a central protrusion and the end of the heat dissipation pipe has a hollow portion. The central protrusion of the heat dissipation pipe mates with the hollow portion of the heat dissipation pipe, so that the heat dissipation pipe and the heat dissipation tray are connected tightly.

A further object of the present invention is to provide a lamp holder of an LED projection lamp, wherein the inner wall of the heat dissipation tray and the outer wall of the lampshade have corresponding connecting configurations, so that the heat dissipation tray and the lampshade are connected tightly.

A further object of the present invention is to provide a lamp holder of an LED projection lamp, wherein the inner wall of the heat dissipation tray and the outer wall of the lampshade have corresponding connecting configurations, so that the lampshade is attached to the heat dissipation tray.

BRIEF DESCRIPTION OF THE DRAWINGS

FIG. 5 is a top view according to the preferred embodiment of the present invention;

FIG. 6 is a sectional view taken along line A-A of FIG. 5;

DETAILED DESCRIPTION OF THE PREFERRED EMBODIMENTS

Embodiments of the present invention will now be described, by way of example only, with reference to the accompanying drawings.

As shown in FIG. 1 through FIG. 6, the lamp holder of an LED projection lamp according to a preferred embodiment of the present invention comprises a heat dissipation pipe 1, a heat dissipation fin unit 2, a heat dissipation tray 3, and a lampshade 4.

Figure 1:
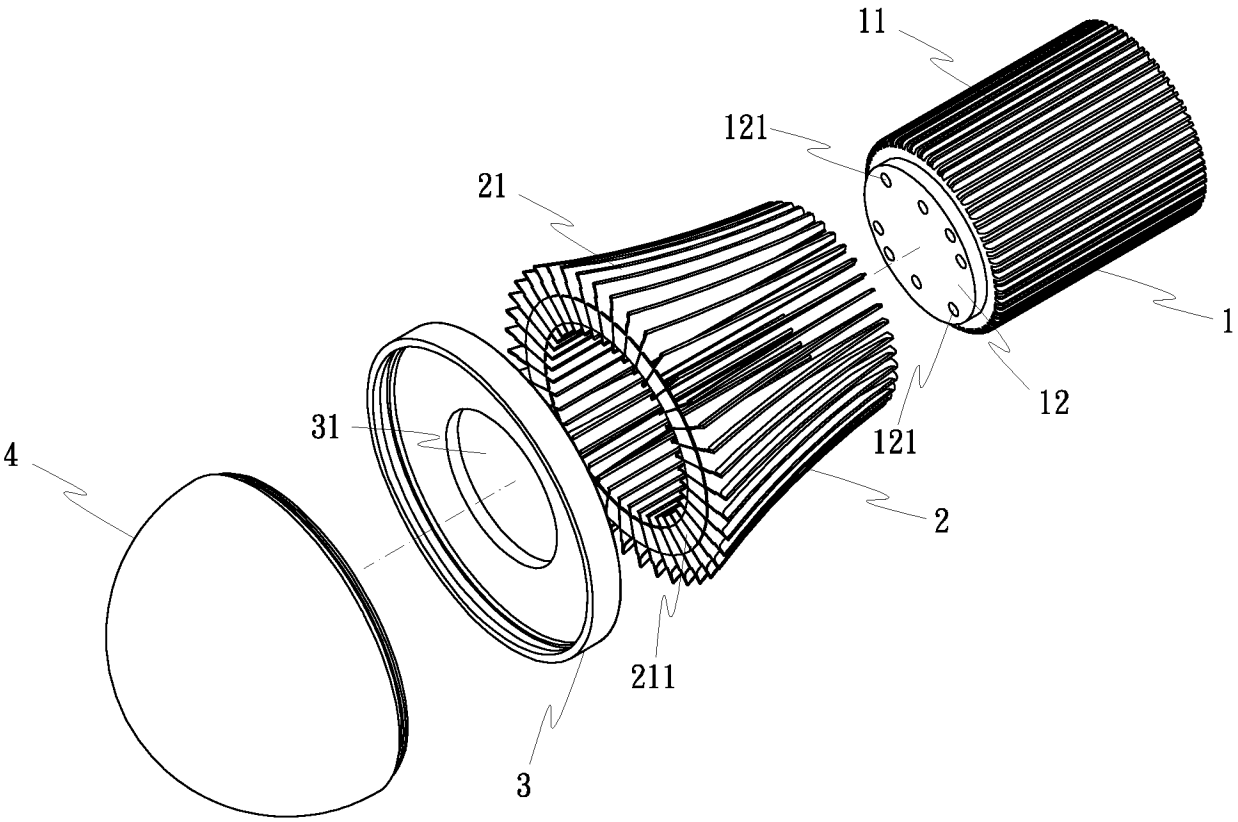
FIG. 1 is an exploded view according to a preferred embodiment of the present invention.

The heat dissipation pipe 1 is a hollow pipe and has a plurality of insertion grooves 11 around an outer circumferential wall thereof. One end of the heat dissipation pipe 1 is connected to the heat dissipation tray 3. As shown in FIG. 1, one end of the heat dissipation pipe 1 has a stepped protrusion 12 and a plurality of wire holes 121 thereon.

The heat dissipation fin unit 2 comprises a plurality of heat dissipation fins 21 to be inserted in the insertion grooves 11 on the outer circumferential wall of the heat dissipation pipe 1. The shape of the heat dissipation fins 21 is not limited to a specific shape.

Figure 2:
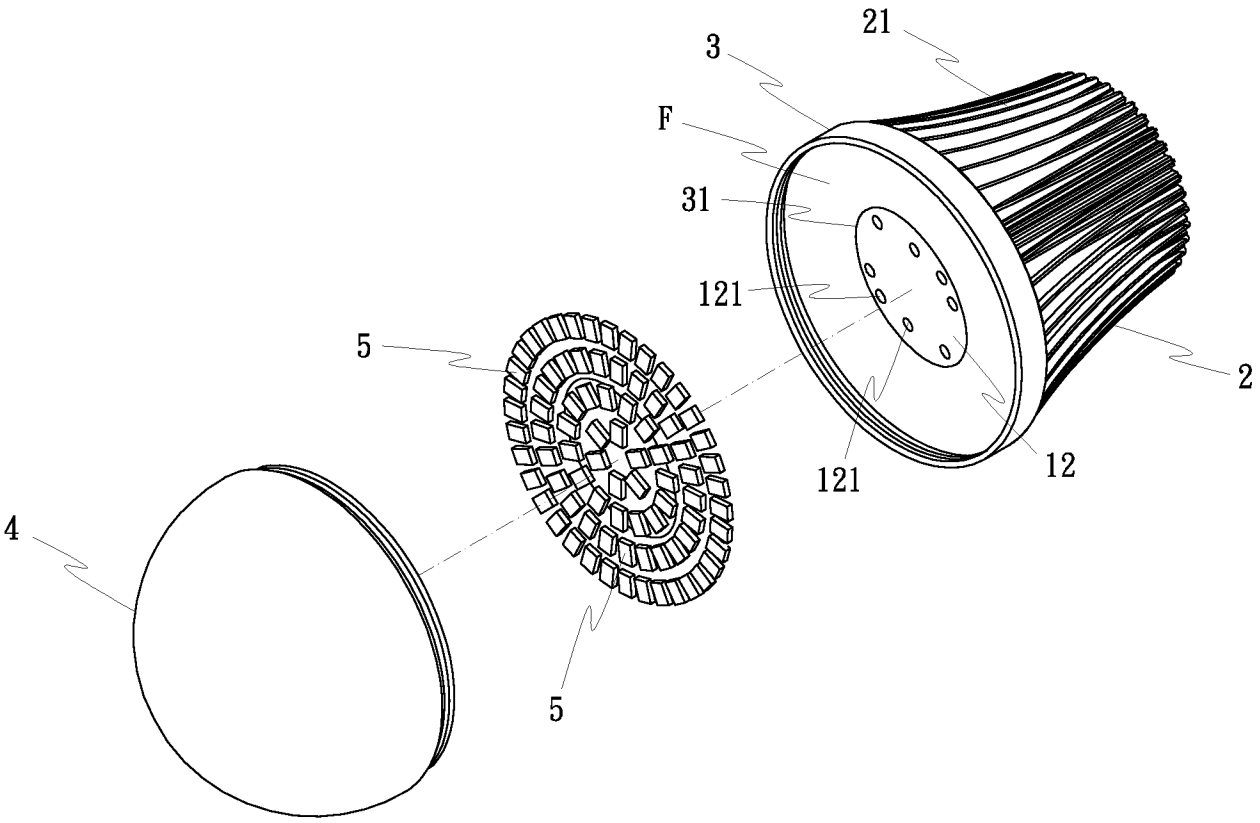
FIG. 2 is a partial exploded view according to the preferred embodiment of the present invention.

The heat dissipation tray 3 is in a disc-like shape and is connected with the end of the heat dissipation pipe 1. As shown in FIG. 1, the heat dissipation tray 3 has a central hole 31 corresponding to the stepped protrusion 12 of the heat dissipation pipe 1. The stepped protrusion 12 of the heat dissipation pipe 1 and the central hole 31 of the heat dissipation tray 3 have a tolerance dimension, so that the heat dissipation pipe 1 and the heat dissipation tray 3 can be connected tightly to form a spacious accommodation surface F, as shown in FIG. 2.

Figure 3:
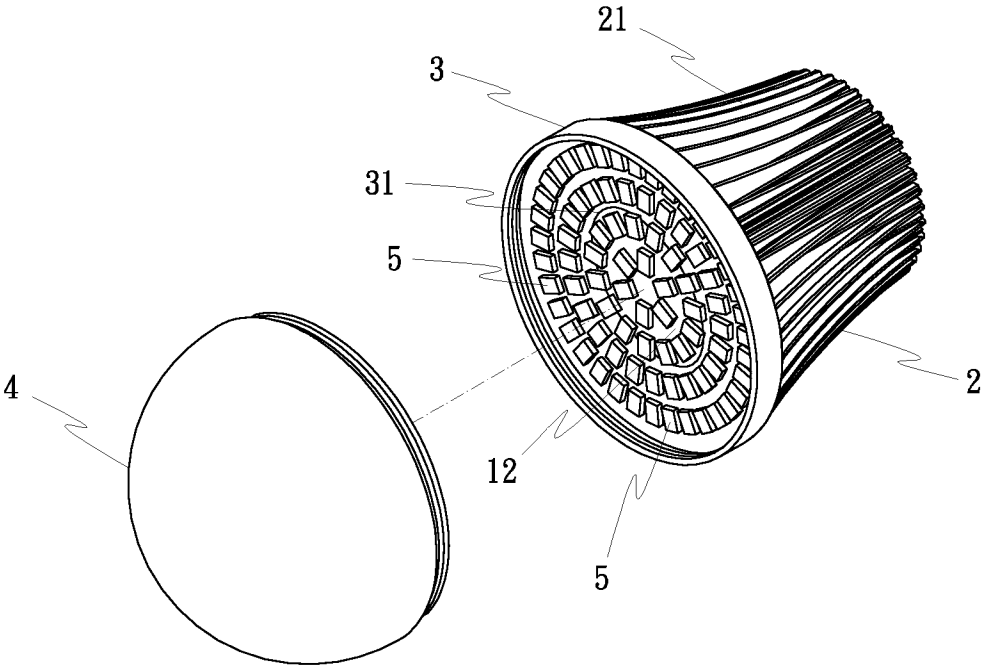
FIG. 3 is an exploded view showing the lampshade before assembled according to the preferred embodiment of the present invention.
Figure 4:
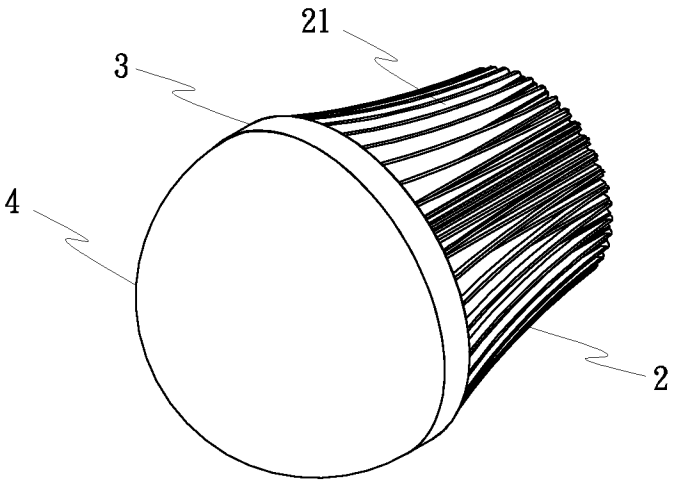
FIG. 4 is a perspective view according to the preferred embodiment of the present invention.

The lampshade 4 is pervious to light. The lampshade 4 can made of glass, plastic or other light-pervious material. As shown in FIG. 3 and FIG. 4, the lampshade 4 is coupled to the heat dissipation tray 3.

The heat dissipation pipe 1, the heat dissipation fin unit 2, the heat dissipation tray 3 and the lampshade 4 are assembled to constitute the lamp holder of the LED projection lamp, as shown in FIG. 5. The end of the heat dissipation pipe 1 is tightly connected to the heat dissipation tray 3 to form the spacious accommodation surface F to accommodate more LED illumination units 5 therein.

As shown in FIG. 1 and FIG. 5, the heat dissipation fins 21 of the heat dissipation fin unit 2 each have a perpendicular bent portion 211 to be in contact with the bottom of the heat dissipation tray 3 and to form an annular surface. By this annular surface, the heat dissipation fin unit 2 is in direct contact with the bottom of the heat dissipation tray 3 to increase the contact area so as to enhance the heat dissipation effect.

The wire holes 121 of the stepped protrusion 12 of the heat dissipation pipe 1 are for the wires of the LED illumination units 5 to be inserted through and into the heat dissipation pipe 1.

The end of the heat dissipation pipe 1 is tightly connected to the heat dissipation tray 3 to form the spacious accommodation surface F to accommodate more LED illumination units 5 therein, so the LED projection lamp of the present invention can provide a better illumination effect.

Figure 7:
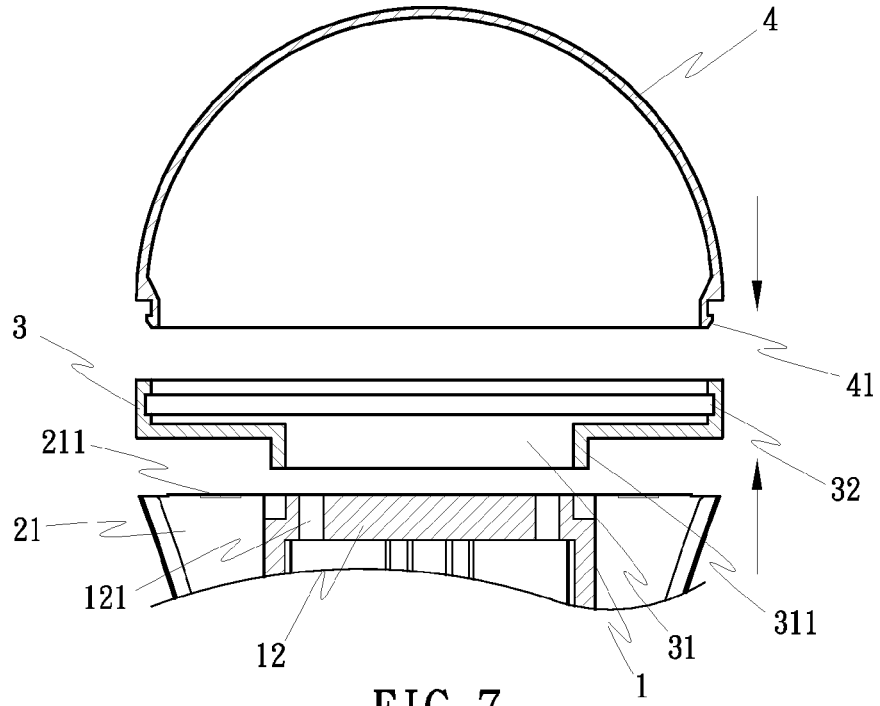
FIG. 7 is a sectional view according to the preferred embodiment of the present invention before assembled.
Figure 8:
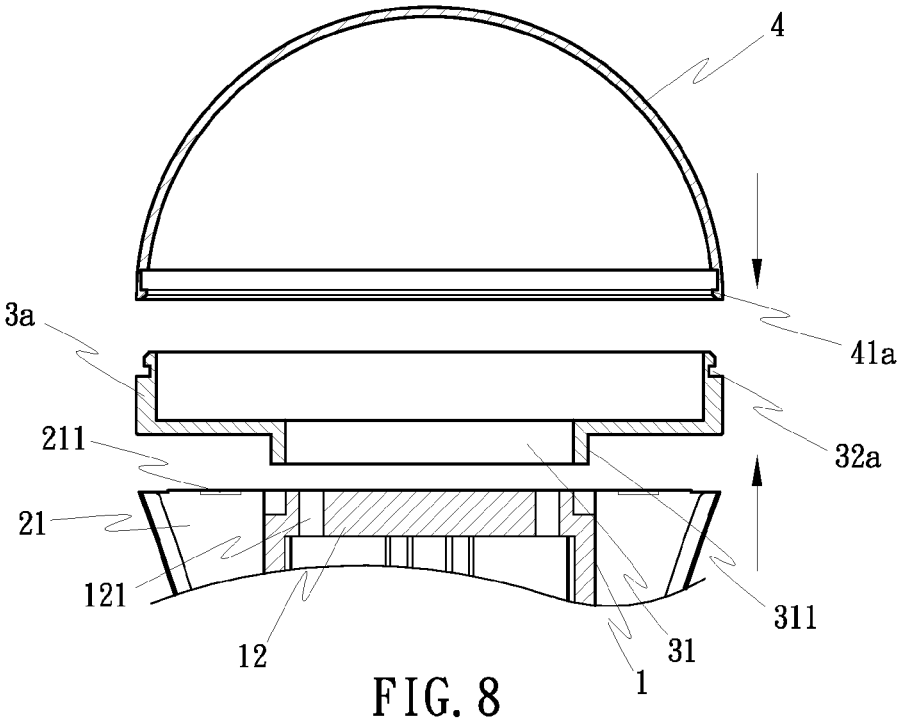
FIGS. 8 to 14 are schematic views showing equivalent embodiments of the present invention.

As shown in FIG. 7 and FIG. 8, the heat dissipation tray 3 has an annular wall 311 extending from the central hole 311 to mate with the stepped protrusion 12 of the heat dissipation pipe 1.

FIG. 7 and FIG. 8 show two different engagement types of the heat dissipation tray 3, 3*a* and the lampshade 4, 4*a*. The heat dissipation tray 3, 3*a* and the lampshade 4, 4*a* have corresponding engaging notches 32, 32*a* and engaging hooks 41, 41*a*, so that the heat dissipation tray 3, 3*a* and the lampshade 4, 4*a* can be coupled quickly. The connection of the heat dissipation tray 3 and the lampshade 4 of the present invention is achieved by means of corresponding engaging configurations, such that the heat dissipation tray 3 and the lampshade 4 can be coupled quickly.

Figure 9:
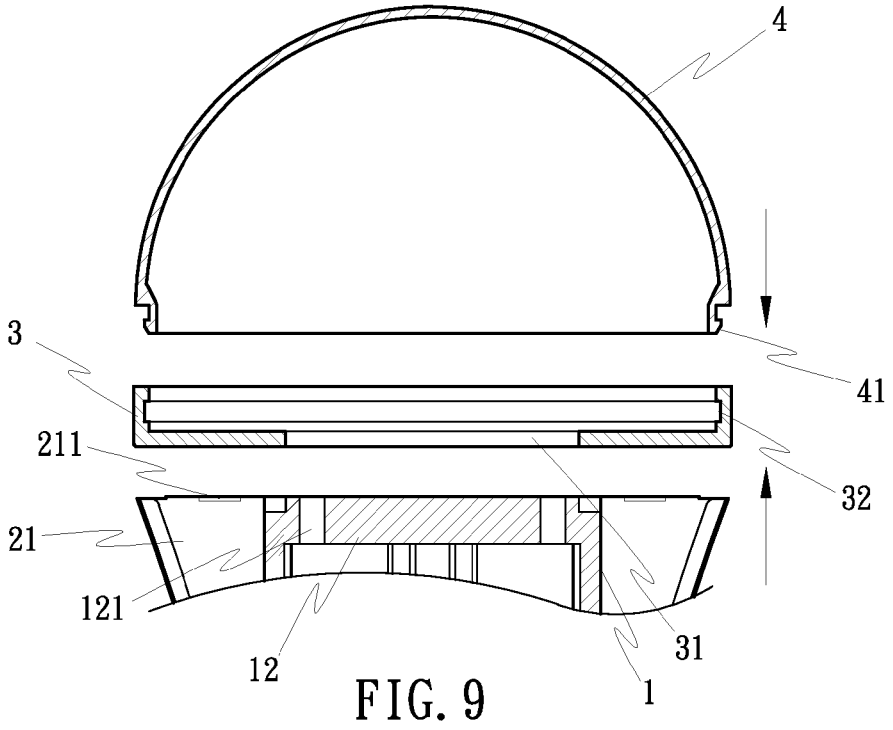
Figure 10:
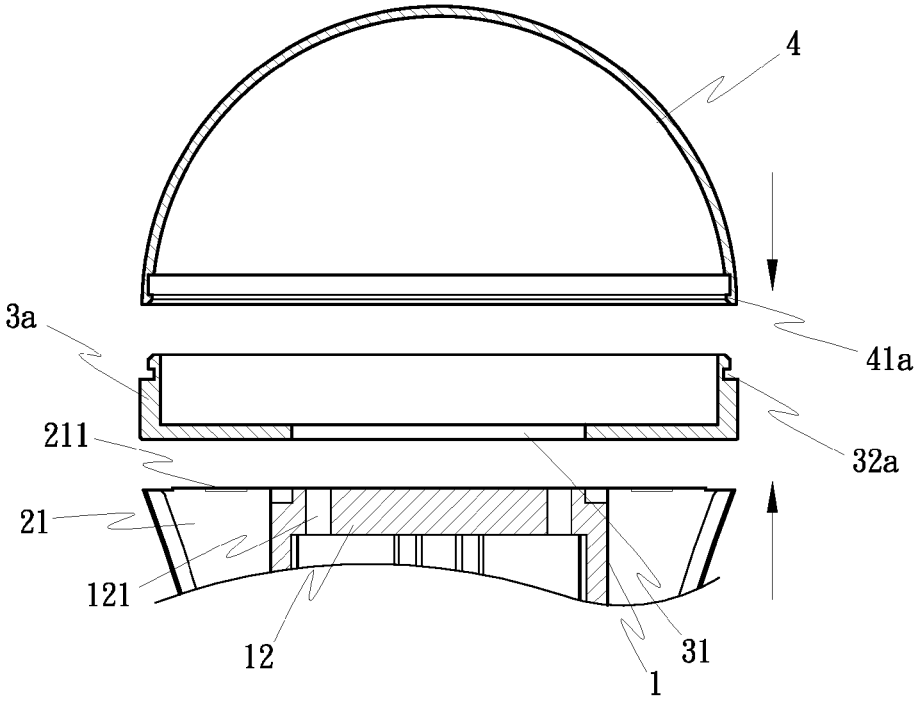

FIG. 9 and FIG. 10 show two different embodiments. The central hole 31 of the heat dissipation tray 3 can be a simple central hole 31 to mate with the stepped protrusion 12 of the heat dissipation pipe 1.

Figure 11:
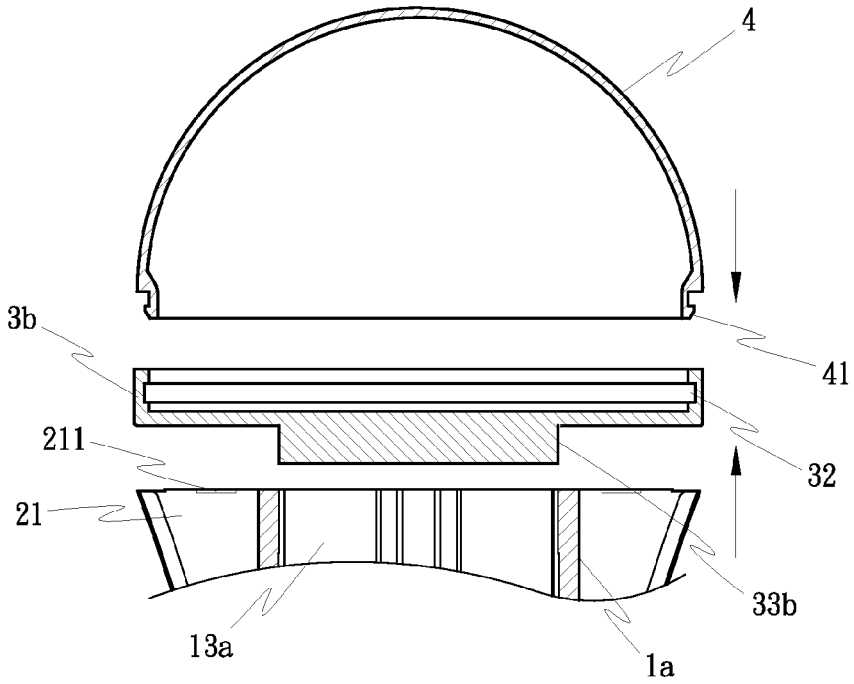
Figure 12:
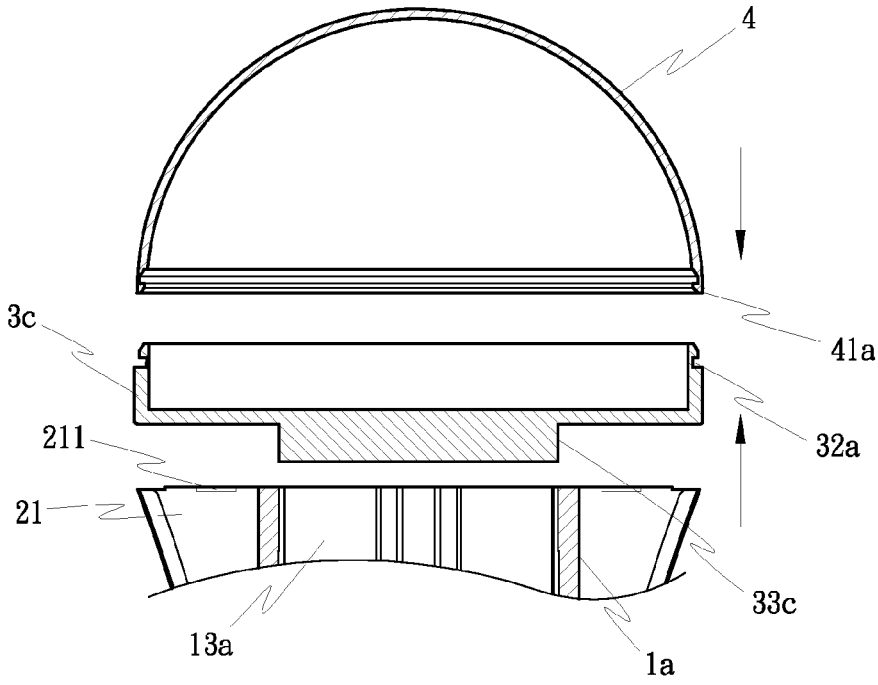

FIG. 11 and FIG. 12 show two equivalent embodiments. The bottom of the heat dissipation tray 3*b*, 3*c* has a central protrusion 33*b*, 33*c*, and the end of the heat dissipation pipe 1*a* has a hollow portion 13*a*. The hollow portion 13*a* of the heat dissipation pipe 1*a* and the central protrusion 33*b*, 33*c* have a tolerance dimension, so that the heat dissipation pipe 1*a* and the heat dissipation tray 3*b*, 3*c* can be connected tightly to form a spacious accommodation surface.

Figure 13:
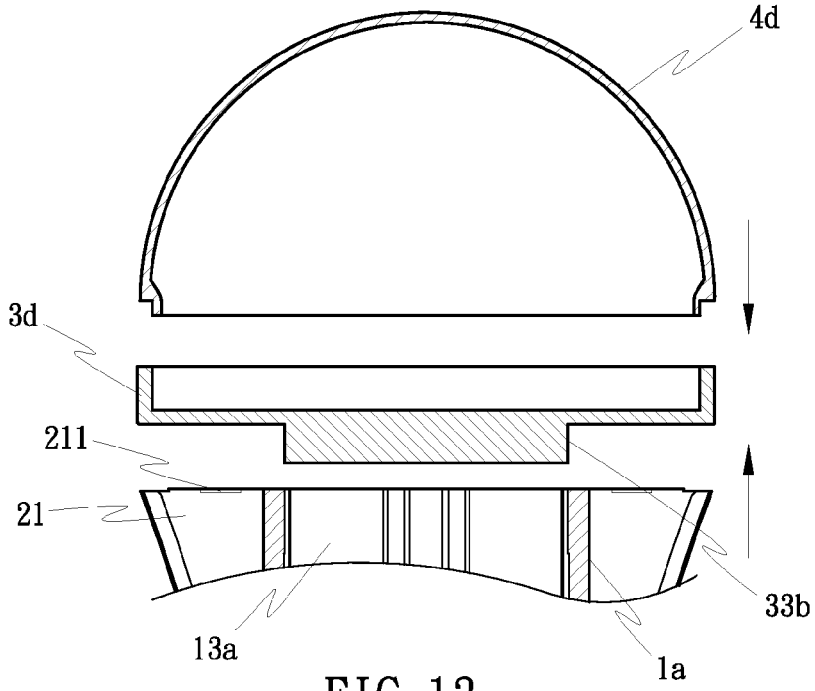
Figure 14:
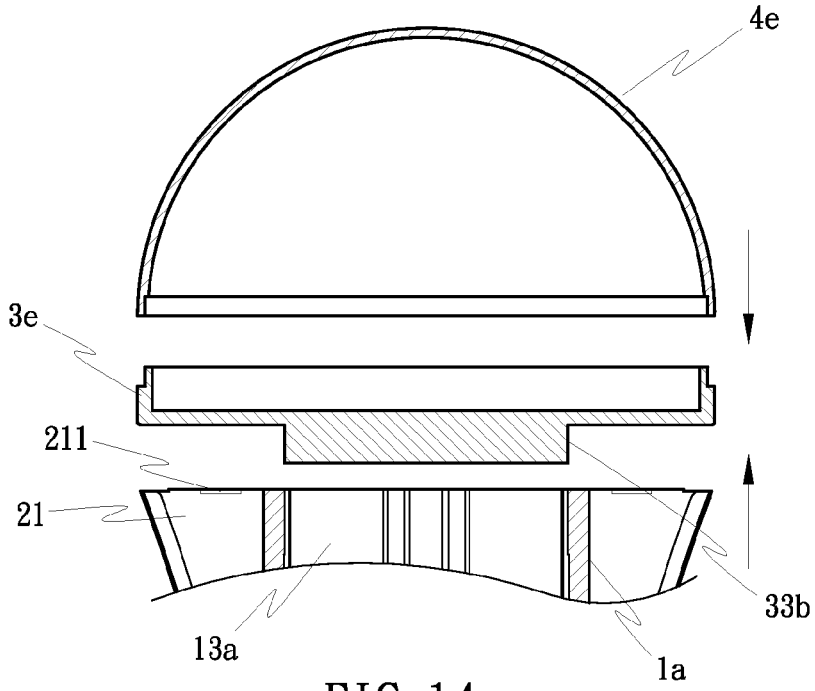

FIG. 13 and FIG. 14 show two equivalent embodiments of connection of the heat dissipation tray 3*d*, 3*e* and the lampshade 4*d*, 4*e*. The inner wall of the heat dissipation tray 3*d*, 3*e* and the outer wall of the lampshade 4*d*, 4*e* have corresponding connecting configurations, so that the heat dissipation tray 3*d*, 3*e* and the lampshade 4*d*, 4*e* can be connected quickly.

Figure 15:
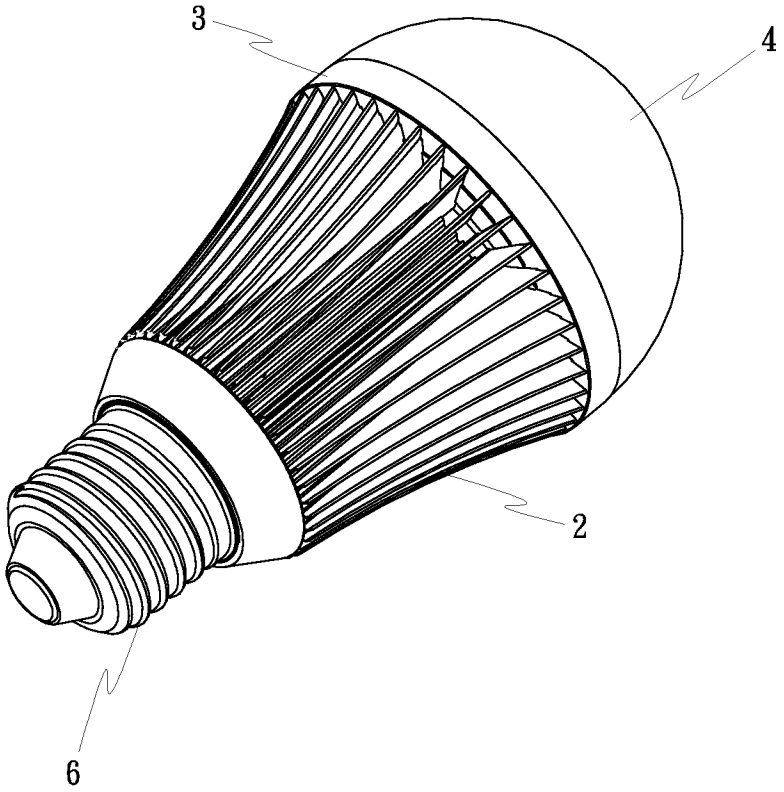
FIG. 15 is a perspective view of the preferred embodiment of the present invention coupled with an electric connector.

FIG. 15 shows the lamp holder of the present invention. The rear end of the heat dissipation pipe 1 is connected with an electric connector 6 which has an insulation sleeve therein to constitute the entire LED projection lamp. The electric connector 6 and the insulation sleeve are prior art, and won't be described in detail.

The heat dissipation pipe 1 can be a solid pipe. One end of the solid pipe has a mating recess to couple with the relative end of the heat dissipation tray. The shape of the heat dissipation pipe 1 is not limited to a circular pipe. It can be a triangular pipe, a tetragonal pipe, a polygonal pipe, or other geometric pipe. The shape and size of the heat dissipation are not limited, which can be changed as desired to mate with the heat dissipation pipe.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp holder of an LED projection lamp, comprising a heat dissipation pipe, a heat dissipation fin unit, a heat dissipation tray, and a lampshade, wherein:

the heat dissipation pipe has a plurality of insertion grooves around an outer circumferential wall thereof, and has a stepped protrusion formed on a front end thereof;

the heat dissipation fin unit comprises a plurality of heat dissipation fins to be inserted in the insertion grooves on the outer circumferential wall of the heat dissipation pipe;

the heat dissipation tray is in a disc-like shape and has a central hole corresponding to the stepped protrusion of the heat dissipation pipe;

the lampshade is pervious to light, and is coupled to the heat dissipation tray; and the front end of the heat dissipation pipe is tightly connected with the heat dissipation tray by engaging the stepped protrusion of the heat dissipation pipe with the central hole of the heat dissipation tray to form an accommodation surface to accommodate a plurality of LED illumination units therein.

2. The lamp holder of an LED projection lamp as claimed in claim 1, wherein the stepped protrusion of the heat dissipation pipe has a plurality of wire holes thereon.

3. The lamp holder of an LED projection lamp as claimed in claim 1, wherein the heat dissipation fins of the heat dissipation fin unit each have a perpendicular bent portion to be in contact with a bottom of the heat dissipation tray and to form an annular surface.

4. The lamp holder of an LED projection lamp as claimed in claim 3, wherein the perpendicular bent portions of the heat dissipation fins to together form an annular surface.

5. The lamp holder of an LED projection lamp as claimed in claim 1, wherein the heat dissipation tray has an annular wall extending from the central hole to mate with the stepped protrusion of the heat dissipation pipe.

6. The lamp holder of an LED projection lamp as claimed in claim 1, wherein the heat dissipation tray and the lampshade have corresponding engaging configurations, so that the heat dissipation tray and the lampshade are coupled tightly.

7. The lamp holder of an LED projection lamp as claimed in claim 1, wherein an inner wall of the heat dissipation tray and an outer wall of the lampshade have corresponding connecting configurations, so the heat dissipation tray and the lampshade are connected.

8. The lamp holder of an LED projection lamp as claimed in claim 1, wherein a rear end of the heat dissipation pipe is connected with an electric connector to constitute the LED projection lamp.

9. A lamp holder of an LED projection lamp, comprising a heat dissipation pipe, a heat dissipation fin unit, a heat dissipation tray, and a lampshade, wherein:

the heat dissipation pipe has a plurality of insertion grooves around an outer circumferential wall thereof, and has a hollow portion on a front end thereof;

the heat dissipation fin unit comprises a plurality of heat dissipation fins to be inserted in the insertion grooves on the outer circumferential wall of the heat dissipation pipe;

the heat dissipation tray is in a disc-like shape and has a bottom formed with a central protrusion corresponding to the hollow portion of the heat dissipation pipe;

the lampshade is pervious to light, and is coupled to the heat dissipation tray; and the front end of the heat dissipation pipe is tightly connected with the heat dissipation tray by mating the central protrusion of the heat dissipation tray with the hollow portion of the heat dissipation pipe to form an accommodation surface to accommodate a plurality of LED illumination units therein.

* * * * *